US008158223B2

(12) United States Patent
Hyakuda et al.

(10) Patent No.: US 8,158,223 B2
(45) Date of Patent: Apr. 17, 2012

(54) INK JET RECORDING MEDIUM AND PRODUCTION PROCESS THEREOF, AND FINE PARTICLE DISPERSION

(75) Inventors: Hirokazu Hyakuda, Wakayama (JP); Hiroshi Kakihira, Fuzi (JP); Hisao Kamo, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 12/865,764

(22) PCT Filed: Mar. 10, 2009

(86) PCT No.: PCT/JP2009/054982

§ 371 (c)(1),
(2), (4) Date: Aug. 2, 2010

(87) PCT Pub. No.: WO2009/113702

PCT Pub. Date: Sep. 17, 2009

(65) Prior Publication Data

US 2011/0008553 A1 Jan. 13, 2011

(30) Foreign Application Priority Data

Mar. 14, 2008 (JP) ..... 2008-066200

(51) Int. Cl.
*B41M 5/40* (2006.01)

(52) U.S. Cl. ..... 428/32.34; 428/32.35; 428/32.36

(58) Field of Classification Search ..... 428/32.34, 428/32.35, 32.36
See application file for complete search history.

(56) References Cited

U.S. PATENT DOCUMENTS

| | | | |
|---|---|---|---|
| 4,202,870 | A | 5/1980 | Weber et al. |
| 4,242,271 | A | 12/1980 | Weber et al. |
| 4,248,852 | A | 2/1981 | Wakabayashi et al. |
| 5,091,009 | A | 2/1992 | Nogami et al. |
| 5,955,185 | A | 9/1999 | Yoshino et al. |
| 5,965,252 | A | 10/1999 | Santo et al. |
| 7,601,779 | B2 | 10/2009 | Hyakuda et al. |
| 7,625,614 | B2 | 12/2009 | Kamo et al. |
| 2005/0253916 | A1 | 11/2005 | Poncelet et al. |
| 2006/0066707 | A1 | 3/2006 | Poncelet et al. |
| 2006/0182906 | A1 | 8/2006 | Kamo et al. |
| 2009/0011155 | A1 | 1/2009 | Kamo et al. |
| 2009/0110828 | A1 | 4/2009 | Nagase et al. |

FOREIGN PATENT DOCUMENTS

| | | | |
|---|---|---|---|
| DE | 25 18 144 | A | 11/1976 |
| EP | 0 701 904 | A1 | 3/1995 |
| EP | 0 741 045 | A1 | 11/1996 |
| EP | 0 749 845 | A2 | 12/1996 |
| GB | 1 497 992 | A | 1/1978 |
| JP | S57-44605 | B2 | 9/1982 |
| JP | H03-013376 | A | 1/1991 |
| JP | H04-034512 | B2 | 6/1992 |
| JP | H06-030951 | B | 4/1994 |
| JP | H07-232473 | A | 9/1995 |
| JP | H07-232475 | A | 9/1995 |
| JP | H08-132731 | A | 5/1996 |
| JP | H09-066664 | A | 3/1997 |
| JP | H09-076628 | A | 3/1997 |
| JP | 2-803134 | B2 | 9/1998 |
| JP | 2-881847 | B2 | 4/1999 |
| JP | H11-245504 | A | 9/1999 |
| JP | 2000-177241 | A | 6/2000 |
| JP | 2001-121812 | A | 5/2001 |
| JP | 2003-080840 | A | 3/2003 |
| JP | 2004-066514 | A | 3/2004 |
| JP | 2004-188667 | A | 7/2004 |
| JP | 2005-007828 | A | 1/2005 |
| JP | 2006-123316 | A | 5/2006 |
| JP | 2007-076034 | A | 3/2007 |
| JP | 2008-012774 | A | 1/2008 |
| WO | 2004-009367 | A1 | 1/2004 |
| WO | 2004-009368 | A1 | 1/2004 |

OTHER PUBLICATIONS

Apr. 21, 2009 International Search Report and Apr. 21, 2009 Written Opinion in International Application No. PCT/JP2009/054982.
Sep. 23, 2010 International Preliminary Report on Patentability and Apr. 21, 2009 Written Opinion in International Application No. PCT/JP2009/054982.

*Primary Examiner* — Betelhem Shewareged
(74) *Attorney, Agent, or Firm* — Fitzpatrick, Cella, Harper & Scinto

(57) ABSTRACT

The invention relates to an ink jet recording medium, in which at least one of a substrate and an ink receiving layer contains a compound of the general formula (1):

(1)

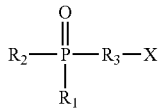

wherein $R_1$ and $R_2$ are individually a hydrogen atom, a hydroxyl group, a linear or branched alkyl group or a substituted or unsubstituted aryl group, with the proviso that $R_1$ and $R_2$ may be the same or different from each other, $R_3$ is a linear or branched alkylene group or arylene group, and X is an acidic solubilizing group.

7 Claims, No Drawings

INK JET RECORDING MEDIUM AND PRODUCTION PROCESS THEREOF, AND FINE PARTICLE DISPERSION

TECHNICAL FIELD

The present invention relates to an ink jet recording medium and a production process thereof, and a fine particle dispersion.

BACKGROUND ART

In an ink-jet recording system, fine droplets of a recording liquid such as an ink are flown by various working principles to apply them to an ink jet recording medium such as paper, thereby making a record of images and/or characters. The ink jet recording medium used in this system has such features that recording can be conducted at high speed and with a low noise, color images can be formed with ease, recording patterns are very flexible, and development is unnecessary, and is hence further developed for output parts in information instruments such as copying machines, word processors, facsimiles and plotters in addition to printers, so that it is rapidly widespread.

In recent years, high-performance digital cameras, digital video cameras and scanners have begun to be provided cheaply, and printers using the ink jet recording system have come to be extremely favorably used for output of image information obtained from such instruments with the spread of personal computers.

Under such a background, there is a demand for simply and easily outputting images comparable in quality with silver salt photographs and multi-color prints of a plate making system using an ink jet recording system. In order to meet such a demand, improvements in structures and recording systems of printers themselves, such as speeding up and higher definition of recording, and full-coloring of images, have been made.

On the other hand, with respect to ink jet recording media used in the ink jet recording system, a wide variety of recording media has heretofore been proposed. An ink jet recording medium capable of forming an image comparable with a silver salt photograph requires formation of an image excellent in coloring of dyes and high in surface glossiness and resolution. In Japanese Patent Application Laid-Open No. H07-232475, an alumina hydrate is used as a component of an ink receiving layer of such an ink jet recoding medium.

Moreover, ink jet recording media have recently been required to have good preservability of images recorded as well. It has thus been proposed to improve the preservability of the recorded image by incorporating an image fading preventing agent for improving light fastness and gas fastness.

Japanese Patent Publication No. H06-030951 discloses a recording sheet containing a particular cationic compound as a method for improving the preservability of an image against light and gasses in the air. Japanese Patent Application Laid-Open No. H03-013376, Japanese Patent Publication No. H04-034512, Japanese Patent Application Laid-Open No. H11-245504 and Japanese Patent Application Laid-Open No. 2001-121812 respectively disclose recording sheets containing a hindered amine compound as a light fastness improver.

On the other hand, Japanese Patent Application Laid-Open No. 2000-177241 discloses a recording medium containing a phosphite compound as an image fading preventing agent. Japanese Patent Application Laid-Open No. 2006-123316 and Japanese Patent Application Laid-Open No. 2004-188667 investigate a recording medium containing a pentavalent phosphate compound and a recording medium containing a pentavalent phosphoric acid derivative, respectively, for the purpose of more improving the image fading preventing property. The recording media containing these pentavalent phosphates are said to be excellent in image preservability compared with the recording media containing the phosphite compound, hindered amine or sulfur compound.

The ink jet recording media described in Japanese Patent Publication No. H06-030951, Japanese Patent Application Laid-Open No. H03-013376, Japanese Patent Publication No. H04-034512, Japanese Patent Application Laid-Open No. H11-245504 and Japanese Patent Application Laid-Open No. 2001-121812 exhibit an effect to some extent on gas fastness and light fastness. However, the gas fastness and light fastness do not reach a level satisfactory to practical use in some cases according to the layer structures or components thereof.

Japanese Patent Application Laid-Open No. 2000-177241, Japanese Patent Application Laid-Open No. 2006-123316 and Japanese Patent Application Laid-Open No. 2004-188667 teach that the effect to prevent image fading is achieved by using the phosphite or pentavalent phosphate compound as an image fading preventing agent. The recording media described in these documents can achieve the improvement in weatherability to some extent by the use of the image fading preventing agent. In order to achieve sufficient image preservability, however, it is necessary to add the image fading preventing agent in a great amount. As a result, image characteristics such as image clearness and ink absorbency are deteriorated.

On the other hand, a dispersion with an inorganic pigment dispersed in a solvent is used for various applications. However, the dispersibility of the inorganic pigment in the solvent is deteriorated according to the materials used and the distribution of the inorganic pigment in a product formed with this dispersion is thus deteriorated to lower the characteristics of the product in some cases. In particular, when a coating liquid for an ink receiving layer of an ink jet recording medium is used as the dispersion, this tendency markedly appears according to materials used in the coating liquid. More specifically, the dispersibility of the inorganic pigment in the coating liquid is deteriorated and the distribution of the inorganic pigment in the ink receiving layer formed by applying and drying this coating liquid becomes uneven to lower the image characteristics of the resulting ink jet recording medium in some cases.

Here, it is considered that a coating liquid for an ink receiving layer which contains an image fading preventing agent such as the phosphite or pentavalent phosphate compound in a solvent and an inorganic pigment is used as the dispersion to produce an ink jet recording medium. In this case, however, the image fading preventing agent is often insoluble in water, and so the agent cannot be added into an aqueous coating liquid, or the dispersibility of the inorganic pigment is deteriorated if the agent can be added, and image characteristics such as image clearness are deteriorated by the unevenness of distribution of the inorganic pigment in the ink receiving layer.

DISCLOSURE OF THE INVENTION

The present inventor has carried out various investigations with a view toward solving the above problems.

As a result, it has been found that when a compound represented by the following general formula (1) is contained in at least one of a substrate and an ink receiving layer, image preservability and image characteristics in ink jet printing are excellent, thus leading to completion of a first invention.

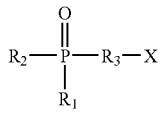

(1)

wherein $R_1$ and $R_2$ are individually any one of a hydrogen atom, a hydroxyl group, a linear or branched alkyl group and a substituted or unsubstituted aryl group, with the proviso that $R_1$ and $R_2$ may be the same or different from each other, $R_3$ is a linear or branched alkylene group or arylene group, and X is an acidic solubilizing group.

It has also been found that when an inorganic pigment and the compound of the general formula (1) are contained in a solvent, the compound of the general formula (1) can serve as a deflocculant to improve the dispersibility of the inorganic pigment in the solvent, thus leading to completion of a second invention.

In other words, it is an object of the first invention to provide an ink jet recording medium having useful image characteristics such as excellent fading preventing property, image clearness and ink absorbency.

It is an object of the second invention to provide a dispersion for ink receiving layers which has excellent dispersibility of an inorganic pigment and excellent preservation stability, and provides uniform distribution of the inorganic pigment even after the formation of an ink receiving layer.

An aspect of the present invention relates to an ink jet recording medium comprising a substrate and an ink receiving layer provided on at least one surface of the substrate, wherein at least one of the substrate and the ink receiving layer contains a compound of the following general formula (1):

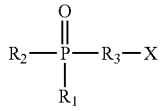

(1)

wherein $R_1$ and $R_2$ are individually a hydrogen atom, a hydroxyl group, a linear or branched alkyl group or a substituted or unsubstituted aryl group, with the proviso that $R_1$ and $R_2$ may be the same or different from each other, $R_3$ is a linear or branched alkylene group or arylene group, and X is an acidic solubilizing group.

Another aspect of the present invention relates to a dispersion for an ink receiving layer, comprising a compound of the following general formula (1), an inorganic pigment and a solvent:

General formula (1)

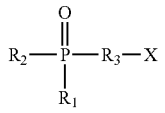

(1)

wherein $R_1$ and $R_2$ are individually a hydrogen atom, a hydroxyl group, a linear or branched alkyl group or a substituted or unsubstituted aryl group, with the proviso that $R_1$ and $R_2$ may be the same or different from each other, $R_3$ is a linear or branched alkylene group or arylene group, and X is an acidic solubilizing group.

According to the present invention, an ink jet recording medium having useful image characteristics such as excellent fading preventing property, image clearness and ink absorbency can be provided.

A dispersion for an ink receiving layer which has excellent dispersibility of an inorganic pigment and provides uniform distribution of the inorganic pigment in the formed ink receiving layer when the dispersion is used as a coating liquid for the ink receiving layer can be provided.

Further features of the present invention will become apparent from the following description of exemplary embodiments.

BEST MODE FOR CARRYING OUT THE INVENTION

The present invention relates to an ink jet recording medium containing a compound of the following general formula (1), a production process thereof and a fine particle dispersion.

General formula (1)

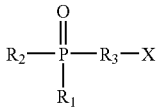

(1)

wherein $R_1$ and $R_2$ are individually any one of a hydrogen atom, a hydroxyl group, a linear or branched alkyl group and a substituted or unsubstituted aryl group, with the proviso that $R_1$ and $R_2$ may be the same or different from each other, $R_3$ is a linear or branched alkylene group or arylene group, and X is an acidic solubilizing group.

The present invention will hereinafter be described in detail with favorable embodiments.

1. Ink Jet Recording Medium

The ink jet recording medium, which is a first invention, has a substrate and an ink receiving layer provided on at least one surface of the substrate. At least one of the substrate and the ink receiving layer contains the compound of the general formula (1), which is a pentavalent phosphate. This ink receiving layer may be provided on one surface of the substrate or on both surfaces of the substrate. The compound of the general formula (1) may be contained in the substrate or the ink receiving layer or in both of the substrate and the ink receiving layer.

The respective materials and components for forming the ink jet recording medium will hereinafter be described. Compound of general formula (1):

The compound of the general formula (1) serves as an image fading preventing agent in the ink jet recording medium. This compound is contained in at least one of the substrate and the ink receiving layer, whereby the image preservability of the ink jet recording medium can be more improved than the case where a conventional trivalent phosphite is used. The reason why the compound of the general formula (1) according to the present invention more improves the image preservability of the ink jet recording medium than the case where a conventional pentavalent phosphate is used is described. The first reason why excellent image preservability is achieved by the compound of the general formula (1) is that the compound of the general formula (1) has an acidic solubilizing group in its molecule. For this reason, in an ink receiving layer of an ink jet recording medium produced by preparing an inorganic pigment dispersion with this compound and applying this dispersion to a substrate and drying it, the compound is more easily adsorbed on or present in the vicinity of an inorganic pigment, which is a component of an ink receiving layer, than the conventional pentavalent phosphate compound. When the compound of the general formula (1) is present in the substrate, the compound is caused to diffuse into the ink receiving layer by an ink solvent having permeated to the substrate, and so the compound is more easily adsorbed on or present in the vicinity of an inorganic pigment, which is a component of the ink receiving layer, than the conventional pentavalent phosphate compound. As described above, the compound of the general formula (1) can have an excellent fading preventing function by being adsorbed on the surface of a pigment molecule or dye molecule to be an ink component or present in the vicinity thereof. As a result, when a pentavalent phosphate compound having no acidic solubilizing group and a compound of the general formula (1) are respectively contained in the same amount, the ink jet recording medium containing the compound of the general formula (1) can exhibit higher weatherability. The second reason why excellent image preservability is achieved by the compound of the general formula (1) is described. The conventional pentavalent phosphate compound and the compound of the general formula (1) improves the image preservability of the resulting ink jet recording medium compared with the case where the conventional trivalent phosphate is used as described above. The reason for this is that the compound of the general formula (1) has high quenching ability against a singlet oxygen generated by xenon or the like in the molecule of a dye or pigment, which is a component of an ink. The singlet oxygen quenching mechanism is not clearly known. However, it is considered that the carbon in the compound of the general formula (1) has a higher singlet oxygen quenching effect than the oxygen, sulfur or ester linkage in the conventional pentavalent phosphate. As a result, even when silica is used as a pigment for an ink receiving layer, the ink jet recording medium containing the compound of the general formula (1) can exhibit higher weatherability when the conventional pentavalent phosphate compound and the compound of the general formula (1) are respectively contained in the same amount.

The compound of the general formula (1) can also be used, for example, as a deflocculant material for a pigment that is a component of an ink receiving layer. In other words, when the pigment and the compound of the general formula (1) are contained in a coating liquid for an ink jet recording medium, dispersibility of the pigment in the coating liquid can be improved. As a result, the distribution of the pigment in the ink receiving layer after drying and solidifying the coating liquid can be made uniform.

Improvement of image fading preventing property and uniformity of the pigment distribution in the ink receiving layer by virtue of the compound of the general formula (1) permits providing an ink jet recording medium excellent in image characteristics such as fading preventing property, image clearness and ink absorbency.

Since the compound of the general formula (1) has the acidic solubilizing group at a terminal thereof, the compound is easy to be solubilized in water and handled. Thus, the compound of the general formula (1) can be easily added to an aqueous coating liquid for an ink receiving layer. As a result, a step of newly overcoating the ink receiving layer with an image fading preventing agent after forming the ink receiving layer or newly adding an image fading preventing agent into the coating liquid for the ink receiving layer like the prior art can be omitted.

The structure of the compound of the general formula (1) will hereinafter be described in detail. The compound of the general formula (1) according to the present invention is not limited thereto.

The compound of the general formula (1) is represented as described below.

General formula (1)

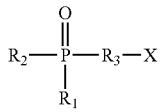

(1)

wherein $R_1$ and $R_2$ are individually any one of a hydrogen atom, a hydroxyl group, a linear or branched alkyl group and a substituted or unsubstituted aryl group, with the proviso that $R_1$ and $R_2$ may be the same or different from each other, $R_3$ is a linear or branched alkylene group or arylene group, and X is an acidic solubilizing group.

The acidic solubilizing group in the compound of the general formula (1) means a group dissociating in water and exhibiting acidity. The acidic solubilizing group may be any group so far as the compound of the general formula (1) is solubilized, and for example, a carboxyl group, sulfonic group or sulfino group may be used. Among these groups, the carboxyl group is favorably used.

$R_1$ and $R_2$ in the compound of the general formula (1) are individually any one of a hydrogen atom, a hydroxyl group, a linear or branched alkyl group and a substituted or unsubstituted aryl group, with the proviso that $R_1$ and $R_2$ may be the same or different from each other. $R_3$ is a linear or branched alkylene group or arylene group. favorable examples of $R_1$, $R_2$ and $R_3$ are mentioned below. However, the structures thereof are not particularly limited so far as the compound of the general formula (1) becomes water-soluble.

Examples of the linear or branched alkyl group for $R_1$ and $R_2$ include methyl, ethyl, butyl, dodecyl, tetradecyl and octadecyl groups. Examples of the substituted or unsubstituted aryl group for $R_1$ and $R_2$ include phenyl, p-methylphenyl, p-ethylphenyl, p-propylphenyl, p-butylphenyl, p-octylphenyl, p-dodecylphenyl and p-octadecylphenyl groups. Examples of the alkylene group for $R_3$ include methylene, ethylene and isopropylene groups, and examples of the arylene group for $R_3$ include phenylene, tolylene and naphthylene groups.

The compound represented by the general formula (1) is favorably a compound represented by the following general formula (2):

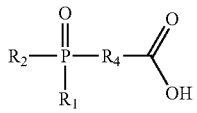

(2)

wherein $R_1$ and $R_2$ are individually any one of a hydrogen atom, a hydroxyl group, a linear or branched alkyl group and a substituted or unsubstituted aryl group, with the proviso that $R_1$ and $R_2$ may be the same or different from each other, and $R_4$ is a methylene, ethylene, isopropylene or phenylene group.

When an inorganic pigment and the compound of the general formula (1) are contained in an ink receiving layer, the favorable content of the compound of the general formula (1) in the ink receiving layer is 0.1 parts by mass or more and 10.0 parts by mass or less per 100 parts by mass of the total solid content of the inorganic pigment. When the content of the compound of the general formula (1) falls within this range, the influence on image recording characteristics by the addition of the image fading preventing agent can be scarcely caused while imparting sufficient weatherability to the resulting ink jet recording medium.

As a process for causing the compound of the general formula (1) to be contained in a substrate, may be mentioned a process in which after the substrate is provided and before an ink receiving layer is formed, a coating liquid containing the compound of the general formula (1) is applied on to the substrate.

As a process for causing the compound of the general formula (1) to be contained in an ink receiving layer, may be mentioned the following processes:

(a) A process in which the compound of the general formula (1) is added into a dispersion of fine particles such as pigment particles, and this dispersion is then applied on to a substrate and dried to form an ink receiving layer;

(b) A process in which the compound of the general formula (1) is added into a coating liquid obtained by mixing a dispersion of fine particles such as pigment particles with a binder, and this coating liquid is then applied on to a substrate and dried to form an ink receiving layer. This production process is specifically described as follows:

a production process of an ink jet recording medium, which has a step of providing a substrate;

a step of mixing a dispersion of fine particles with a water-soluble resin to obtain a coating liquid; and a step of applying the coating liquid on to at least one surface of the substrate followed by drying.

(c) A process in which an ink receiving layer is formed in advance, and a coating liquid containing the compound of the general formula (1) is then applied on to the ink receiving layer.

The process for causing the compound of the general formula (1) to be contained in the ink receiving layer is not limited to the processes (a) to (c), yet the process (b) is favorable from the viewpoint of productivity.

Ink Receiving Layer:

The ink receiving layer of the ink jet recording medium favorably contains a pigment and a binder in addition to the compound of the general formula (1). As the pigment, may be used an inorganic pigment or organic pigment.

As examples of the inorganic pigment, may be mentioned precipitated calcium carbonate, heavy calcium carbonate, magnesium carbonate, kaolin, aluminum silicate, diatomaceous earth, calcium silicate, magnesium silicate, synthetic amorphous silica, colloidal silica, alumina, alumina hydrate and magnesium hydroxide.

As examples of the organic pigment, may be mentioned styrenic plastic pigments, acrylic plastic pigments, polyethylene particles, microcapsule particles, urea resin particles and melamine resin particles.

As the pigment, one of them may be chosen for use, or two or more of them may be used in combination as needed. Among these pigments, inorganic pigments are favorably used from the viewpoints of dye fixing ability, transparency, print density, coloring ability and glossiness, and alumina hydrate is more favorably used.

A finely particulate pigment having an average particle size of 1 mm or less is favorably used as the pigment, and fine silica particles or fine alumina particles such as alumina or alumina hydrate are more favorable. Fine silica particles typified by commercially available colloidal silica are favorable as the fine silica particles. As examples of particularly favorable fine silica particles, may be mentioned those disclosed in Japanese Patent Nos. 2803134 and 2881847. Alumina hydrate is favorable as the alumina pigment. Incidentally, the alumina hydrate is represented by the following general formula (3)

$$Al_2O_{3-n}(OH)_{2n}.mH_2O \quad (3)$$

wherein n is any one of 1, 2 and 3, and m is a number falling within a range of from 0 to 10, favorably from 0 to 5, with the proviso that m and n are not 0 at the same time. In many cases, $mH_2O$ represents an eliminable aqueous phase, which does not participate in the formation of a crystal lattice. Therefore, m may take a value of an integer or a value other than the integer. When this kind of material is heated, m may reach a value of 0 in some cases.

The alumina hydrate can be generally produced according to publicly known processes. As examples of specific processes, may be mentioned processes in which an aluminum alkoxide or sodium aluminate is hydrolized (U.S. Pat. Nos. 4,242,271 and 4,202,870). In addition, a process in which an aqueous solution of aluminum sulfate or aluminum chloride is added to an aqueous solution of sodium aluminate to conduct neutralization (Japanese Patent Publication No. 57-447605) may be mentioned.

Alumina hydrate showing a beohmite structure or amorphous structure when analyzed by X-ray diffractometry is favorable. As such alumina hydrate, alumina hydrates described in Japanese Patent Application Laid-Open Nos. H07-0232473, H08-132731, H09-066664 and H09-076628 are particularly favorable.

As the binder, may be used conventionally known binders, such as polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose and hydroxypropylmethyl cellulose, conjugated diene copolymer latexes such as SBR latexes, NBR latexes and methyl methacrylate-butadiene copolymers, functional-group-modified polymer latexes, vinyl copolymer latexes such as ethylene-vinyl acetate copolymers, polyvinyl pyrrolidone, maleic anhydride polymers or copolymers thereof, and acrylic ester copolymers. These binders may be used either singly or in any combination thereof. A water-soluble resin is favorably used as the binder, and polyvinyl alcohol is more favorably used. In this case, a conventionally known binder may be used in combination with polyvinyl alcohol. When the pigment is contained in the ink receiving layer, the content of the binder in the ink receiving layer is favorably controlled to 5 parts by mass or more and 20 parts by mass or less per 100 parts by mass of the pigment.

One or more boric acid compounds are favorably contained as a crosslinking agent in the ink receiving layer. As boric acid compounds usable in this case, may be mentioned not only orthoboric acid ($H_3BO_3$), but also metaboric acid and diboric acid. Salts of boric acid are favorably water-soluble salts of the above-described boric acid compounds. As specific examples thereof, may be mentioned alkali metal salts such as sodium salts of boric acid ($Na_2B_4O_7.10H_2O$, $NaBO_2.4H_2O$, etc.) and potassium salts of boric acid ($K_2B_4O_7.5H_2O$, $KBO_2$, etc.), ammonium salts of boric acid ($NH_4B_4O_9.3H_2O$, $NH_4B_4O_9$, etc.), and alkaline earth metal salts such as magnesium salts and calcium salts of boric acid. Among these compounds, orthoboric acid is favorably used from the viewpoints of stability with time of the resulting coating liquid and an effect of inhibiting the occurrence of cracks.

The amount of the boric acid compound used is favorably within a range of 1.0 part by mass or more and 15.0 parts by mass or less per 100 parts by weight of the binder in the ink receiving layer. When the amount of the boric acid compound used falls within the above range, the stability with time of the resulting coating liquid can be improved. In other words, even when the coating liquid is used over a long period of time upon production, neither viscosity increase of the coating liquid nor occurrence of gelled products is caused. As a result, replacement of the coating liquid or cleaning of a coater head is not required, so that productivity can be improved. Even when the amount falls within this range, occurrence of cracks can be more effectively prevented by more suitably selecting production conditions.

The ink receiving layer favorably has pore properties satisfying the following conditions from the viewpoint of achieving the objects and effects such as high ink absorbency and high fixing ability.

(1) The pore volume of the ink receiving layer is favorably within a range of from 0.1 $cm^3/g$ or more and 1.0 $cm^3/g$ or less. When the pore volume of the ink receiving layer is 0.1 $cm^3/g$ or more, sufficient ink-absorbing performance is achieved, and an ink receiving layer excellent in ink absorbency can be provided. When the pore volume of the ink receiving layer is 1.0 $cm^3/g$ or less, ink overflowing or image bleeding can be prevented, and moreover the resulting ink receiving layer can be made so that cracking and powdery coming-off are not easily caused.

(2) The BET specific surface area of the ink receiving layer is favorably 20 $m^2/g$ or more and 450 $m^2/g$ or less. When the BET specific surface area of the ink receiving layer is 20 $m^2/g$ or more, sufficient glossiness is achieved, and haze is lowered (transparency is improved). In this case, the ability to adsorb a dye in an ink is improved. When the BET specific surface area of the ink receiving layer is 450 $m^2/g$ or less, such an ink receiving layer does not easily cause cracking. Incidentally, the values of the pore volume and BET specific surface area can be determined by nitrogen adsorption and desorption method.

To the ink receiving layer, other additives than the compound of the general formula (1) may also be added as needed. As examples of the other additives, may be mentioned dispersants, thickeners, pH adjustors, lubricants, flowability modifiers, surfactants, antifoaming agents, parting agents, optical whitening agents, ultraviolet light absorbers and antioxidants.

The dry coating amount of the ink receiving layer is favorably 30 $g/m^2$ or more and 60 $g/m^2$ or less taking high ink absorbency into consideration. When the dry coating amount of the ink receiving layer is 30 $g/m^2$ or more, sufficient ink absorbency is achieved, and so it is prevented to cause ink overflowing to cause bleeding. In addition, an ink receiving layer exhibiting sufficient ink absorbency under a high-temperature and high-humidity environment can be provided. In particular, this tendency becomes marked when the resulting recording medium is used for a printer in which a black ink and a plurality of light shade inks are used in addition to 3 color inks of cyan, magenta and yellow. When the dry coating amount is 60 $g/m^2$ or less, the occurrence of cracking can be prevented. In addition, the resulting ink receiving layer can be made so as not to easily cause coating unevenness and so as to have a stable thickness.

Substrate:

As the substrate used in the present invention, may favorably be used, for example, a film or a substrate made of paper such as cast-coated paper, baryta paper or resin-coated paper (resin-coated paper obtained by coating both surfaces thereof with a resin such as a polyolefin). Example of usable films include films of thermoplastics such as polyethylene, polypropylene, polyester, polylactic acid, polystyrene, polyacetate, polyvinyl chloride, cellulose acetate, polyethylene terephthalate, polymethyl methacrylate and polycarbonate.

Besides these materials, non-sized paper or coat paper, which is properly sized paper, or a sheet-like material (for example, synthetic paper) made of a film opacified by filling of an inorganic material or by minute bubbling may also be used. A sheet made of glass or metal may also be used. In order to improve adhesive strength between such a substrate and an ink receiving layer, the surface of the substrate may be subjected to a corona discharge treatment or various kinds of undercoating treatment.

2. Dispersion for Ink Receiving Layer

The dispersion for ink receiving layer, which is a second invention, contains a compound of the following general formula (1), an inorganic pigment and a solvent:

General formula (1)

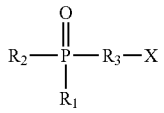

(1)

wherein $R_1$ and $R_2$ are individually any one of a hydrogen atom, a hydroxyl group, a linear or branched alkyl group and a substituted or unsubstituted aryl group, with the proviso that $R_1$ and $R_2$ may be the same or different from each other, $R_3$ is a linear or branched alkylene group or arylene group, and X is an acidic solubilizing group.

As the compound of the general formula (1), may be used the compound described above in "Compound of general formula (1)" in "1. Ink Jet Recording Medium".

Examples of the inorganic pigment include precipitated calcium carbonate, heavy calcium carbonate, magnesium carbonate, kaolin, aluminum silicate, diatomaceous earth, calcium silicate, magnesium silicate, synthetic amorphous silica, colloidal silica, alumina hydrate and magnesium hydroxide. Among these pigments, alumina hydrate is favorably used as the inorganic pigment.

No particular limitation is imposed on the solvent so far as it can stably disperse the inorganic pigment. For example, water or a mixed solution of an organic solvent miscible with water and water may be used. Examples of the organic solvent miscible with water include alcohols such as methanol, ethanol and propanol; lower alkyl ethers of polyhydric alcohols such as ethylene glycol monomethyl ether and ethylene glycol dimethyl ether; ketones such as acetone and methyl ethyl ketone; and ethers such as tetrahydrofuran.

Since the compound of the general formula (1) has the acidic solubilizing group and dissociates by being dissolved in water, the compound may be used as a deflocculating acid for the inorganic pigment. Therefore, the dispersibility of the inorganic pigment in the solvent can be improved to make uniform the distribution of the inorganic pigment in a layer obtained by drying the dispersion containing the inorganic pigment and the solvent according to the present invention to form a film.

Accordingly, when the dispersion for ink receiving layer according to the present invention is used as a coating liquid for an ink receiving layer of an ink jet recording medium, the inorganic pigment can be uniformly distributed in the ink receiving layer as formed. In addition, the compound of the general formula (1) exhibits an excellent effect as an image fading preventing agent. Accordingly, an ink jet recording medium excellent in image characteristics can be provided by virtue of improvement in image fading preventing property by the compound of the general formula (1) and improvement in image clearness by making uniform the distribution of the inorganic pigment. The dispersion according to the present invention, to which the compound according to the present invention is added, is a uniform dispersion, so that the preservability of the dispersion itself is excellent.

Alumina hydrate is favorably used as the inorganic pigment. The alumina hydrate has a property of easily causing aggregation and precipitation in a solvent. However, the aggregation and precipitation can be effectively inhibited by the compound of the general formula (1). As a result, the compound of the general formula (1) is added into the solvent, whereby the dispersibility of the alumina hydrate can be improved.

Incidentally, in the dispersion for ink receiving layer according to the present invention, an organic acid such as acetic acid, formic acid or oxalic acid, or an inorganic acid such as nitric acid, hydrochloric acid or sulfuric acid may be used in combination in addition to the compound of the general formula (1), so far as no detrimental influence is thereby imposed on the dispersibility of the inorganic pigment. The dispersion contains at least one of the organic acids and the inorganic acids, whereby the dispersibility of the inorganic pigment can be more improved.

The content of the compound of the general formula (1) in the dispersion is favorably 0.1 parts by mass or more and 10.0 parts by mass or less per 100 parts by mass of the inorganic pigment. The compound of the general formula (1) is more favorably contained in a proportion of 0.5 parts by mass or more and 10.0 parts by mass or less per 100 parts by mass of the inorganic pigment. When the content of the compound of the general formula (1) falls within the above range, the inorganic pigment can be effectively dispersed in the solvent. In addition, viscosity increase of the dispersion with time and increase in the particle size of the fine inorganic particles in the dispersion is prevented. Further, when the dispersion according to the present invention is used as a coaling liquid for an ink receiving layer of an ink jet recording medium, image characteristics such as ink absorbency, image clearness and image preservability can be improved.

Incidentally, an exemplary production process in the case where the dispersion of fine particles is used to produce an ink jet recording medium is as follows:

A production process of the ink jet recording medium, which has a step of providing a substrate;

a step of mixing a dispersion of fine particles with a water-soluble resin to obtain a coating liquid; and a step of applying the coating liquid on to at least one surface of the substrate and drying the coating liquid.

EXAMPLES

The present invention will hereinafter be described in more detail by the Examples and Comparative Examples. However, the present invention is not limited to these examples.

1. Preparation of Ink Jet Recording Medium

Phosphorus Compound:

Phosphorus compounds represented below were used as the compound of the general formula (1) according to the present invention.

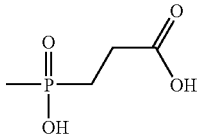

(Phosphorus Compound 1)

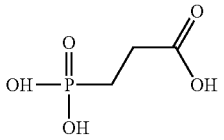

(Phosphorus Compound 2)

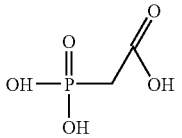

(Phosphorus Compound 3)

Preparation of Substrate:

A substrate was prepared in the following manner. A stock of the following composition was first prepared:

| | |
|---|---|
| Pulp slurry | 100 parts by mass |
| Laulholz bleached kraft pulp (LBKP) having a freeness of 450 ml CSF (Canadian Standard Freeness) | 80 parts by mass |
| Nadelholz bleached kraft pulp (NBKP) having a freeness of 480 ml CSF | 20 parts by mass |
| Cationized starch | 0.60 parts by mass |
| Heavy calcium carbonate | 10 parts by mass |
| Precipitated calcium carbonate | 15 parts by mass |
| Alkyl ketene dimmer | 0.10 parts by mass |
| Cationic polyacrylamide | 0.030 parts by mass. |

Paper was then made from this stock by means of a Fourdrinier paper machine, subjected to 3-stage wet pressing and dried by means of a multi-cylinder dryer. After the resultant paper was impregnated with an aqueous solution of oxidized starch by means of a size press so as to give a solid content of 1.0 g/m$^2$, and dried, the paper was finished by a machine calender to obtain Paper Substrate A having a basis weight of 170 g/m$^2$, a Stöckigt sizing degree of 100 seconds, an air permeability of 50 seconds, a Bekk smoothness of 30 seconds and a Gurley stiffness of 11.0 mN.

A resin composition composed of low density polyethylene (70 parts by mass), high density polyethylene (20 parts by mass) and titanium oxide (10 parts by mass) was then applied to a surface of Paper Substrate A, on which an ink receiving layer will be provided, in an amount of 25 g/m$^2$. A resin composition composed of high density polyethylene (50 parts by mass) and low density polyethylene (50 parts by mass) was further applied to the other surface of the paper substrate A in an amount of 25 g/m$^2$, thereby obtaining Substrate A with both surfaces thereof coated with the resins.

Example 1

Preparation of Dispersion 1 of Fine Particles

Alumina hydrate (DISPERAL HP14, product of Sasol Co.) as inorganic pigment particles was first added into pure water so as to give a concentration of 23% by mass, thereby obtaining an aqueous solution of alumina hydrate. Phosphorous Compound 1 was then added to this aqueous solution of alumina hydrate such that "(Phosphorous Compound 1)/(alumina hydrate)×100" was 0.5 parts by mass in terms of solid mass, and the resultant mixture was stirred to obtain Dispersion 1 of fine particles.

Preparation of Ink Jet Recording Medium 1:

Polyvinyl alcohol PVA 235 (product of Kuraray Co., Ltd.; polymerization degree: 3,500, saponification degree: 88%) was dissolved in ion-exchange water to obtain an aqueous solution of PVA having a solid content of 8.0% by mass. Dispersion 1 of fine particles prepared above and the PVA solution thus prepared were mixed such that "(polyvinyl alcohol)/(alumina hydrate)×100" was 10 parts by mass in terms of solid mass, thereby obtaining a mixed liquid. A 3.0% by mass aqueous solution of boric acid was mixed with the mixed liquid such that "(boric acid)/(alumina hydrate)×100" was 1.7 parts by mass in terms of solid mass, thereby obtaining a coating liquid for ink receiving layer. The resultant coating liquid was applied to the surface of Substrate A with both surfaces thereof coated with the resins by a die coater so as to give a dry coating amount of 35 g/m$^2$, thereby obtaining Ink Jet Recording Medium 1.

Example 2

Alumina hydrate (DISPERAL HP14, product of Sasol Co.) as inorganic pigment particles was first added into pure water so as to give a concentration of 23% by mass, thereby obtaining an aqueous solution of alumina hydrate. Phosphorous Compound 1 was then added to this aqueous solution of alumina hydrate such that "(Phosphorous Compound 1)/(alumina hydrate)×100" was 1.0 part by mass in terms of solid mass, and the resultant mixture was stirred to obtain Dispersion 2 of fine particles. Ink Jet Recording Medium 2 was then prepared in the same manner as in Example 1 except that Dispersion 1 of fine particles in Example 1 was changed to Dispersion 2 of fine particles.

Example 3

Dispersion 3 of fine particles was prepared in the same manner as in Dispersion 1 of fine particles in Example 1 except that "(Phosphorous Compound 1)/(alumina hydrate)×100" was changed to 2.0 parts by mass. Ink Jet Recording Medium 3 was then prepared in the same manner as in Example 1 except that Dispersion 1 of fine particles in Example 1 was changed to Dispersion 3 of fine particles.

Example 4

Dispersion 4 of fine particles was prepared in the same manner as in Dispersion 1 of fine particles in Example 1 except that "(Phosphorous Compound 1)/(alumina hydrate)×100" was changed to 4.0 parts by mass. Ink Jet Recording Medium 4 was then prepared in the same manner as in Example 1 except that Dispersion 1 of fine particles in Example 1 was changed to Dispersion 4 of fine particles.

Example 5

Dispersion 5 of fine particles was prepared in the same manner as in Dispersion 1 of fine particles in Example 1 except that "(Phosphorous Compound 1)/(alumina hydrate)×100" was changed to 6.0 parts by mass. Ink Jet Recording Medium 5 was then prepared in the same manner as in Example 1 except that Dispersion 1 of fine particles in Example 1 was changed to Dispersion 5 of fine particles.

Example 6

Dispersion 6 of fine particles was prepared in the same manner as in Dispersion 1 of fine particles in Example 1 except that "(Phosphorous Compound 1)/(alumina hydrate)×100" was changed to 10.0 parts by mass. Ink Jet Recording Medium 6 was then prepared in the same manner as in Example 1 except that Dispersion 1 of fine particles in Example 1 was changed to Dispersion 6 of fine particles.

Example 7

Dispersion 7 of fine particles was prepared in the same manner as in Dispersion 4 of fine particles in Example 4 except that Phosphorous Compound 1 was changed to Phosphorus Compound 2. Ink Jet Recording Medium 7 was then prepared in the same manner as in Example 1 except that Dispersion 1 of fine particles in Example 1 was changed to Dispersion 7 of fine particles.

Example 8

Dispersion 8 of fine particles was prepared in the same manner as in Dispersion 4 of fine particles in Example 4 except that Phosphorous Compound 1 was changed to Phosphorus Compound 3. Ink Jet Recording Medium 8 was then prepared in the same manner as in Example 1 except that Dispersion 1 of fine particles in Example 1 was changed to Dispersion 8 of fine particles.

Example 9

Alumina hydrate (DISPERAL HP14, product of Sasol Co.) as inorganic pigment particles was first added into pure water so as to give a concentration of 23% by mass, thereby obtaining an aqueous solution of alumina hydrate. Phosphorous Compound 1 was then added to this aqueous solution of alumina hydrate such that "(Phosphorous Compound 1)/(alumina hydrate)×100" was 0.1 parts by mass in terms of solid mass. Acetic acid was subsequently added such that "(acetic acid)/(alumina hydrate)×100" was 1.9 parts by mass in terms of solid mass, and the resultant mixture was stirred to obtain Dispersion 9 of fine particles. Ink Jet Recording Medium 9 was then prepared in the same manner as in Example 1 except that Dispersion 1 of fine particles in Example 1 was changed to Dispersion 9 of fine particles.

Example 10

Alumina hydrate (DISPERAL HP14, product of Sasol Co.) as inorganic pigment particles was first added into pure water so as to give a concentration of 23% by mass, thereby obtaining an aqueous solution of alumina hydrate. Acetic acid was then added to this aqueous solution of alumina hydrate such that "(acetic acid)/(alumina hydrate)×100" was 2.0 parts by mass in terms of solid mass, thereby obtaining Dispersion 10 of fine particles. Phosphorous Compound 1 was then added to Dispersion 10 of fine particles such that "(Phosphorous Compound 1)/(alumina hydrate)×100" was 4.0 parts by mass in terms of solid mass. Ink Jet Recording Medium 10 was then prepared in the same manner as in Example 1.

Example 11

Ink Jet Recording Medium 11 was prepared in the same manner as in Example 10 except that Phosphorous Compound 1 in Example 10 was changed to Phosphorous Compound 2.

Example 12

Ink Jet Recording Medium 12 was prepared in the same manner as in Example 10 except that Phosphorous Compound 1 in Example 10 was changed to Phosphorous Compound 3.

Example 13

Dispersion 10 of fine particles was prepared in the same manner as in Example 10. An ink receiving layer was then formed in the same manner as in Example 1 except that Dispersion 1 of fine particles in Example 1 was changed to Dispersion 10 of fine particles. A 5% by mass solution of Phosphorous Compound 1 in MIBK (methyl isobutyl ketone) was then applied on to this ink receiving layer by a Meyer bar such that "(Phosphorous Compound 1)/(alumina hydrate)×100" was 4.0 parts by mass in terms of solid mass, thereby preparing Ink Jet Recording Medium 13.

Example 14

Ink Jet Recording Medium 14 was prepared in the same manner as in Example 13 except that Phosphorous Compound 1 in Example 13 was changed to Phosphorous Compound 2.

Example 15

Ink Jet Recording Medium 15 was prepared in the same manner as in Example 13 except that Phosphorous Compound 1 in Example 13 was changed to Phosphorous Compound 3.

Example 16

Silica prepared by a vapor phase method (Aerosil 380, product of Nippon Aerosil Co., Ltd.) as inorganic pigment particles was first added into pure water so as to give a concentration of 10% by mass. A dimethyldiallyl-ammonium chloride homopolymer (SHALLOL DC902P, product of DAI-ICHI KOGYO SEIYAKU CO., LTD.) was then added such that "(SHALLOL DC902P)/(silica)×100" was 4.0 parts by mass in terms of solid mass. Thereafter, the resultant mixture was dispersed by a high-pressure homogenizer to prepare Dispersion 11 of fine silica particles. Phosphorous Compound 1 was then added to Dispersion 11 of fine particles such that "(Phosphorous Compound 1)/(silica)×100" was 4.0 parts by mass in terms of solid mass. Thereafter, the aqueous solution of PVA described in Example 1 was added to Dispersion 11 of fine particles such that "(polyvinyl alcohol)/(silica)×100" was 20 parts by mass in terms of solid mass, thereby obtaining a mixed liquid. A 3.0% by mass aqueous solution of boric acid was mixed with the mixed liquid such that "(boric acid)/(silica)×100" was 6.0 parts by mass in terms of solid mass, thereby obtaining a coating liquid for ink receiving layer. The resultant coating liquid was then applied on to the same substrate as that used in Example 1 by the same method as in Example 1 so as to give a dry coating amount of 25 g/m$^2$, thereby obtaining Ink Jet Recording Medium 16.

Example 17

Dispersion 11 (before the addition of Phosphorous Compound 1) of fine particles was prepared in the same manner as in Example 16. An ink receiving layer was then formed in the same manner as in Example 1 except that Dispersion 1 of fine particles was changed to Dispersion 11 of fine particles. A 5% by mass solution of Phosphorous Compound 1 in MIBK (methyl isobutyl ketone) was then applied on to this ink receiving layer by a Meyer bar such that "(Phosphorous Compound 1)/(silica)×100" was 4.0 parts by mass in terms of solid mass, thereby preparing Ink Jet Recording Medium 17.

Example 18

An undercoating layer was formed on the above-described Substrate A in the following manner. First, 7 parts by weight of a commercially available styrene-butadiene latex was added to a slurry that is composed of 100 parts by weight of a filler material containing kaolin (Ultrawhite 90, product of Engelhard Co.), zinc oxide and alumina hydroxide at a weight ratio of 65/10/25 and 0.1 parts by weight of a commercially available polyacrylic dispersant and has a solid content concentration of 70% by weight, and the resultant mixture was adjusted so as to give a solid content of 60% by weight, thereby obtaining a composition as a coating liquid used in the formation of an undercoating layer. This composition was then applied to both surfaces of the substrate by a blade coater so as to give a dry coating amount of 15 g/m$^2$, and dried. Thereafter, the thus-processed substrate was finished by a machine calender (linear pressure: 150 kgf/cm) to obtain an undercoating-layer-applied substrate having a basis weight of 185 g/m$^2$, a Stöckigt sizing degree of 300 seconds, an air permeability of 3,000 seconds, a Bekk smoothness of 200 seconds and a Gurley stiffness of 11.5 mN. The whiteness degree of the undercoating-layer-applied substrate was determined to be the average value by measuring it on each of 5 A4-sized samples obtained by cutting the substrate. As a result, it was found to be L*:95, a*:0 and b*:−2 (defined as a hue prescribed in JIS Z 8729).

The undercoating layers obtained above were then subjected to a surface treatment by the following process. A precoating liquid (100 g in total) having the following composition warmed to 30° C. was first applied by means of a bar coater so as to give a wet coating amount of 16 g/m$^2$.

Precoating Liquid:

Sodium tetraborate: 5 g

Isopropanol: 0.15 g

Phosphorous Compound 1: 7.81 g

Ion-exchange water: balance.

Polyvinyl alcohol PVA 235 (product of Kuraray Co., Ltd.; polymerization degree: 3,500, saponification degree: 88%) was dissolved in ion-exchange water to obtain an aqueous solution of PVA having a solid content of 8.0% by mass. Dispersion 1 of fine particles prepared above and the PVA solution thus prepared were mixed such that "(polyvinyl alcohol)/(alumina hydrate)×100" was 10 parts by mass in terms of solid mass, thereby obtaining a mixed liquid. A 3.0% by mass aqueous solution of boric acid was mixed with the mixed liquid such that "(boric acid)/(alumina hydrate)×100" was 1.7 parts by mass in terms of solid mass, thereby obtaining a coating liquid for ink receiving layer. The resultant coating liquid was applied to the surface of substrate coated with the precoating liquid by a die coater so as to give a dry coating amount of 35 g/m$^2$, thereby obtaining Ink Jet Recording Medium 18.

Comparative Example 1

Dispersion 10 (before the addition of Phosphorous Compound 1) of fine particles was prepared in the same manner as in Example 10. Ink Jet Recording Medium 19 was prepared in the same manner as in Example 1 except that Dispersion 1 of fine particles was changed to Dispersion 10 of fine particles.

Comparative Example 2

A 5% by mass solution of tris(2,4-di-t-butyl-phenyl) phosphite in MIBK (methyl isobutyl ketone) was applied on to the ink receiving layer of Recording Medium 19 obtained in Comparative Example 1 by a Meyer bar such that tris(2,4-di-t-butyl-phenyl) phosphite was 4.0 parts by mass per 100 parts by mass of the solid content of alumina, thereby preparing Ink Jet Recording Medium 20.

Comparative Example 3

A 5% by mass solution of dibutyl phosphite in MIBK (methyl isobutyl ketone) was applied on to the ink receiving layer of Recording Medium 19 obtained in Comparative Example 1 by a Meyer bar such that dibutyl phosphite was 4.0 parts by mass per 100 parts by mass of the solid content of alumina, thereby preparing Ink Jet Recording Medium 21.

Comparative Example 4

Ink Jet Recording Medium 22 was prepared in the same manner as in Example 17 except that Phosphorous Compound 1 in Example 17 was changed to dibutyl phosphate.

Comparative Example 5

Ink Jet Recording Medium 23 was prepared in the same manner as in Example 18 except that Phosphorous Compound 1 was removed from the precoating liquid in Example 18.

2. Evaluation of Ink Jet Recording Medium

Ink Jet Recording Media 1 to 23 prepared in Examples 1 to 18 and Comparative Examples 1 to 5 were used to make evaluation as to 3 items: a) image preservability (xenon fastness, ozone fastness) of recorded articles, b) ink absorbency, and c) image recording characteristics. Evaluation results thus obtained are shown collectively in Table 1.

a) Image Preservability of Recorded Article

Preparation of Recorded Article:

A photo printer (trade name: PIXUS IP8600, ink: BCl-7, manufactured by Canon Inc.) using an ink jet system was used. More specifically, respective single-color patches of black, cyan, magenta and yellow were printed on the recording surfaces of Ink Jet Recording Media 1 to 23 prepared in Examples and Comparative Examples such that the optical densities (OD) thereof were respectively about 1.0, thereby preparing recorded articles.

<Xenon Fastness>

The above-described recorded articles were subjected to a xenon exposure test by means of Xenon Weathermeter (XL-75C Model, manufactured by SUGA TEST INSTRUMENTS CO., LTD.).

Testing Conditions:

Accumulated irradiation: 40,000 klx

Temperature and humidity conditions in the testing chamber: 23° C. and 50% RH.

Evaluating Method of Xenon Fastness:

Optical densities of each of the above-described recorded articles before and after the test were measured by means of a spectrophotometer (trade name: Spectro Lino; manufactured by GretagMacbeth Co.) to determine the density retentions according to the following equation, thereby evaluating the xenon fastness based on the following evaluation criteria.

Density retention(%)=(Optical density after test/Optical density before test)×100.

(Evaluation Criteria)

A: Density retention of yellow is 85% or more;

B: Density retention of yellow is 80% or more and less then 85%;

C: Density retention of yellow is 70% or more and less then 80%;

D: Density retention of yellow is less than 70%.

<Ozone Fastness>

An ozone exposure test was conducted by means of Ozone Weathermeter (OMS-HS Model, manufactured by SUGA TEST INSTRUMENTS CO., LTD.).

Testing Conditions:

Exposing gas composition: ozone 10 ppm

Testing time: 8 hours

Temperature and humidity conditions in the testing chamber: 23° C. and 50% RH.

Evaluating Method of Ozone Fastness:

The L* value, a* value and b* value of each of the above-described recorded articles were measured by means of a spectrophotometer (trade name: Spectro Lino; manufactured by GretagMacbeth Co.) to determine ΔE according to the following equation, thereby evaluating the ozone fastness based on the following evaluation criteria.

$$\Delta E=\{(L^* \text{ value of a recorded article before test}-L^* \text{ value of the recorded article after test})^2+(a^* \text{ value of the recorded article before test}-a^* \text{ value of the recorded article after test})^2+(b^* \text{ value of the recorded article before test}-b^* \text{ value of the recorded article after test})_2\}_{1/2}.$$

(Evaluation Criteria)

A: The greatest color difference ΔE from the initial image among the respective single-color patches of black, cyan, magenta and yellow is less than 5;

B: The greatest color difference ΔE from the initial image among the respective single-color patches of black, cyan, magenta and yellow is 5 or more and less than 10;

C: The greatest color difference ΔE from the initial image among the respective single-color patches of black, cyan, magenta and yellow is 10 or more.

b) Ink Absorbency

Printing was conducted on the recording surfaces of Ink Jet Recording Media 1 to 23 prepared in Examples and Comparative Examples by means of a photo printer (trade name: PIXUS IP8600, ink: BCl-7, manufactured by Canon Inc.). More specifically, patches of 8 intermediate color gradations from cyan monochrome to magenta monochrome were respectively printed to prepare recorded articles. With respect to each patch of the recorded articles thus obtained, the image quality thereof was visually observed, thereby overall evaluating the ink absorbency based on the following evaluation criteria.

E: Some problem is observed on all the evaluation items, and problems are caused for use.

The materials used in the respective ink jet recording media prepared in Examples and Comparative Examples and evaluation results are shown in Table 1.

TABLE 1

| | Recording Medium | Fine particle dispersion used | Phosphorus compound contained Kind | Phosphorus compound contained Content | Image preservability Ozone fastness | Image preservability Xenon fastness | Ink absorbency | Image recording charactertstics |
|---|---|---|---|---|---|---|---|---|
| Ex. 1 | 1 | Dispersion 1 | Phosphorus Compound 1 | 0.5 parts | A | B | A | A |
| Ex. 2 | 2 | Dispersion 2 | Phosphorus Compound 1 | 1 part | A | B | A | A |
| Ex. 3 | 3 | Dispersion 3 | Phosphorus Compound 1 | 2 parts | A | A | A | A |
| Ex. 4 | 4 | Dispersion 4 | Phosphorus Compound 1 | 4 parts | A | A | A | A |
| Ex. 5 | 5 | Dispersion 5 | Phosphorus Compound 1 | 6 parts | A | A | B | B |
| Ex. 6 | 6 | Dispersion 6 | Phosphorus Compound 1 | 10 parts | A | A | B | B |
| Ex. 7 | 7 | Dispersion 7 | Phosphorus Compound 2 | 4 parts | A | A | A | A |
| Ex. 8 | 8 | Dispersion 8 | Phosphorus Compound 3 | 4 parts | A | A | A | A |
| Ex. 9 | 9 | Dispersion 9 | Phosphorus Compound 1 | 0.1 parts | A | B | A | A |
| Ex. 10 | 10 | Dispersion 10 | Phosphorus Compound 1 | 4 parts | A | B | A | A |
| Ex. 11 | 11 | Dispersion 10 | Phosphorus Compound 2 | 4 parts | A | B | A | A |
| Ex. 12 | 12 | Dispersion 10 | Phosphorus Compound 3 | 4 parts | A | B | A | A |
| Ex. 13 | 13 | Dispersion 10 | Phosphorus Compound 1 | 4 parts | A | B | B | B |
| Ex. 14 | 14 | Dispersion 10 | Phosphorus Compound 2 | 4 parts | A | B | B | B |
| Ex. 15 | 15 | Dispersion 10 | Phosphorus Compound 3 | 4 parts | A | B | B | B |
| Ex. 16 | 16 | Dispersion 11 | Phosphorus Compound 1 | 4 parts | A | B | A | A |
| Ex. 17 | 17 | Dispersion 11 | Phosphorus Compound 1 | 4 parts | A | B | B | B |
| Ex. 18 | 18 | Dispersion 1 | Phosphorus Compound 1 | 4 parts | A | A | A | A |
| Comp. Ex. 1 | 19 | Dispersion 10 | — | — | C | D | A | A |
| Comp. Ex. 2 | 20 | Dispersion 10 | Tris(2,4-di-t-butylphenyl)phosphite | 4 parts | C | D | D | D |
| Comp. Ex. 3 | 21 | Dispersion 10 | Dibutyl phosphite | 4 parts | B | C | D | D |
| Comp. Ex. 4 | 22 | Dispersion 10 | Dibutyl phosphate | 4 parts | B | C | D | D |
| Comp. Ex. 5 | 23 | Dispersion 10 | — | — | C | D | A | A |

(Evaluation Criteria)

A: The uniformity to shading in the patch is particularly excellent;

B: Shading is scarcely observed in the patch, and uniformity is excellent;

C: Shading is somewhat observed in the patch.

D: Shading is observed in the patch, but is at a level of causing no particular problem upon practical use;

E: Shading is observed at a level of causing a problem upon practical use.

c) Image Recording Characteristics (Overall Evaluation Based on Clearness etc. of Actual Image)

Printing was conducted on the recording surfaces of Ink Jet Recording Media 1 to 23 prepared in Examples and Comparative Examples by means of a photo printer (trade name: PIXUS IP8600, ink: BCI-7, manufactured by Canon Inc.). More specifically, portrait (ISO/JIS-SCID N1) images were printed to prepare recorded articles. The resultant recorded articles were evaluated as to 4 items: 1) a grain feeling, 2) shading of image, 3) brightness of color and 4) bleeding of fine line, thereby overall evaluating the image recording characteristics based on the following evaluation criteria.

(Evaluation Criteria)

A: Extremely excellent without causing a problem on any evaluation item;

B: Excellent though a slight problem is observed on some of the evaluation items;

C: No problem is caused for use though a problem is somewhat observed on some of the evaluation items;

D: A problem is somewhat observed on some of the evaluation items, and some problem is caused for use;

As apparent from the results shown in Table 1, it is understood that all the ink jet recording media of Examples have excellent image preservability as demonstrated by "A" or "B" in the evaluation of the image preservability (ozone fastness and xenon fastness).

It is understood that good results are also shown in the ink absorbency and image recording characteristics. On the other hand, it is understood that the ink jet recording media of Comparative Examples 1 and 2 are poor in image preservability as demonstrated by "C" or "D" in the evaluation of the image preservability (ozone fastness and xenon fastness).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-066200, filed Mar. 14, 2008, which is hereby incorporated by reference herein in its entirety.

The invention claimed is:

1. An ink jet recording medium comprising a substrate and an ink receiving layer provided on at least one surface of the substrate, wherein the ink receiving layer contains an inorganic pigment, wherein at least one of the substrate and the ink receiving layer contains a compound of the following general formula (1):

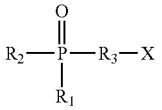

(1)

wherein $R_1$ and $R_2$ are individually a hydrogen atom, a hydroxyl group, a linear or branched alkyl group or a substituted or unsubstituted aryl group, with the proviso that $R_1$ and $R_2$ may be the same or different from each other, $R_3$ is a linear or branched alkylene group or arylene group, and X is an acidic solubilizing group selected from the group consisting of a carboxyl group, a sulfonic group, and a sulfino group, and wherein the compound of the general formula (1) is contained in a proportion of 0.1 parts by mass or more and 10.0 parts by mass or less per 100 parts by mass of the inorganic pigment.

2. The ink jet recording medium according to claim 1, wherein the ink receiving layer contains a water-soluble resin.

3. The ink jet recording medium according to claim 1, wherein the inorganic pigment is at least one of silica and alumina hydrate.

4. A dispersion for an ink receiving layer, comprising a compound of the following general formula (1), an inorganic pigment and a solvent, General formula (1)

General formula (1)

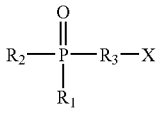

(1)

wherein $R_1$ and $R_2$ are individually a hydrogen atom, a hydroxyl group, a linear or branched alkyl group or a substituted or unsubstituted aryl group, with the proviso that $R_1$ and $R_2$ may be the same or different from each other, $R_3$ is a linear or branched alkylene group or arylene group, and X is an acidic solubilizing group selected from the group consisting of a carboxyl group, a sulfonic group, and a sulfino group, and wherein the compound of the general formula (1) is contained in a proportion of 0.1 parts by mass or more and 10.0 parts by mass or less per 100 parts by mass of the inorganic pigment.

5. The dispersion for an ink receiving layer according to claim 4, wherein the inorganic pigment is alumina hydrate.

6. The dispersion for an ink receiving layer according to claim 4, which further comprises at least one of an organic acid and an inorganic acid.

7. A process for producing an ink jet recording medium, comprising the steps of:

providing a substrate;

mixing the dispersion for an ink receiving layer according to claim 6 with a water-soluble resin to obtain a coating liquid; and applying the coating liquid on to at least one surface of the substrate followed by drying.

* * * * *